US007686362B2

(12) United States Patent
Layher

(10) Patent No.: US 7,686,362 B2
(45) Date of Patent: Mar. 30, 2010

(54) STONE LIFTING DEVICE

(75) Inventor: Karl-Heinz Layher, Kirchberg/Murr (DE)

(73) Assignee: Probst Greiftechnik Verlegesysteme GmbH, Erdmannshausen (DE)

( * ) Notice: Subject to any disclaimer, the term of this patent is extended or adjusted under 35 U.S.C. 154(b) by 249 days.

(21) Appl. No.: 11/899,323

(22) Filed: Sep. 5, 2007

(65) Prior Publication Data

US 2009/0058116 A1 Mar. 5, 2009

(51) Int. Cl.
*B65G 7/12* (2006.01)

(52) U.S. Cl. ..... 294/62; 294/118

(58) Field of Classification Search ..... 294/16, 294/50.8, 50.9, 62, 103.1, 104, 118; 52/127.5, 52/749.11

See application file for complete search history.

(56) References Cited

U.S. PATENT DOCUMENTS 113,799 A * 4/1871 Rugg ..... 294/62
117,297 A * 7/1871 Jones ..... 294/50.8
127,212 A * 5/1872 Aylworth ..... 81/336
199,501 A * 1/1878 Bowman ..... 111/101
346,136 A * 7/1886 Towner ..... 294/118
2,789,006 A * 4/1957 Mattson ..... 294/118
2,821,426 A * 1/1958 Hanner ..... 294/26
2,936,192 A * 5/1960 Lince ..... 294/16
5,429,401 A * 7/1995 Youmans ..... 294/1.4
5,575,518 A * 11/1996 Payne ..... 294/16

* cited by examiner

*Primary Examiner*—Dean J Kramer
(74) *Attorney, Agent, or Firm*—Karl F. Milde, Jr.; Eckert Seamans Cherin & Mellott, LLC

(57) ABSTRACT

A stone lifting device comprises two handles (2, 3) that pivot in relation to each other. A first gripping jaw (11) is located at the one end region of the one handle (2) and a second gripping jaw (9) is located at the one end region of the other handle (3). The one handle (2) and the other handle (3) can be pivoted at their end regions in relation to each other around an axis (7) such that in a clamping position a cobblestone can be clamped between the first gripping jaw (11) and the second gripping jaw (9). A locking mechanism (12) is provided that can be either activated or deactivated. In their activated condition in the clamping position the positions of the handles (2, 3) are maintained and the cobblestone remains clamped between the gripping jaws (9, 11). In the deactivated condition the clamping position is maintained by a clamping force that is exerted onto the handles (2, 3) manually by an operator.

12 Claims, 2 Drawing Sheets

STONE LIFTING DEVICE

BACKGROUND OF THE INVENTION

The present invention relates to a stone lifting device which is suitable for lifting cobblestones, paving stones and the like from their preset positions in the ground.

Such stone lifting devices are already known. Their purpose in particular is to pull out individual, e.g., damaged or sunken stones from existing cobblestone pavements, which may consist of composite stone, clinker brick, natural stone, and slabs of various shapes, and to replace said stones with corresponding new ones. For parking lots, it is common to initially build the entire cobblestone pavement for economic reasons so as not to interfere with the work progress, and only then, prior to compacting, use stone lifting devices to lift out individual stones and replace them with colored marking stones. Also for setting posts or cornerstones, etc., it is often necessary to remove individual cobblestones from cobblestone pavement.

In particular, the trend to premium cobblestone material with specially treated surfaces often requires replacing damaged stones after sand has been filled in the gaps between the stones and the pavement has been compacted. These stones are solidly anchored to the adjacent stones and it is very difficult to pull them out.

In this regard, stone lifting devices are known that essentially are built in the form of pliers and exhibit two handles, which are pivoted in relation to each other at a common lower center of rotation. One of the handles exhibits a gripping jaw, which can be inserted in the gap adjacent to one side of the cobblestone to be lifted out. Correspondingly, the other handle exhibits a gripping jaw, which can be inserted in the gap adjacent to the opposite side of the cobblestone. Both gripping jaws consist of hardened spring steel and are designed in a knife-like manner such that they can be inserted into the gaps with ease. By moving the handles toward each other, the cobblestone is clamped between the two gripping jaws such that it can be lifted out of the cobblestone pavement through a vertical movement of the stone lifting device.

However, one problem is that for stones that are solidly embedded in the cobblestone pavement working with such a stone lifting device is relatively laborious because during the entire manipulation of a stone, the operating person must exert one force to clamp the cobblestone between the gripping jaws and at the same time exert another force to lift the stone lifting device vertically.

To overcome this difficulty, a self-clamping stone lifting device has been developed and is available commercially from Feltes GmbH, D-40882 Ratingen, Germany, where the handles are connected to each other via a clamping design, which in part applies and maintains the force for moving the gripping parts through its own weight.

However, one problem of this known self-clamping stone lifting device is that its design is relatively complex and complicated and that its handling is cumbersome. Furthermore, modifying the clamping force is cumbersome requiring the adjustment of setscrews and the like.

SUMMARY OF THE INVENTION

It is, therefore, the objective of the present invention to propose a stone lifting device such that it offers easy handling for cobblestones both solidly embedded and not solidly anchored in the cobblestone pavement while offering a relatively simple design.

This objective is achieved by a stone lifting device with the features of Patent claim 1.

The significant advantage of the stone lifting device subject to the invention is that it is very easy to handle both for lifting stones that are not solidly anchored in the cobblestone pavement (where the gaps in the cobblestone pavement have not yet been filled with sand and the pavement has not yet been compacted) as well as for lifting stones that are solidly anchored in the cobblestone pavement (where the cobblestone pavement has already been filled with sand and compacted). This can be attributed to the fact that the stone lifting device subject to the invention exhibits a locking mechanism that can be activated or deactivated. In the deactivated condition, work can be carried out in the usual manner with the clamping force and the vertical lifting force being exerted by the operator. This is particularly recommended when handling cobblestones that are not yet anchored solidly in the cobblestone pavement. As an alternative, the locking mechanism can be activated in particular when handling stones that are solidly anchored in the cobblestone pavement, such that the handles are locked together in a position that clamps the cobblestone that is held between the two gripping jaws. The operator no longer needs to exert any clamping force. This avoids early tiring of the operator.

In a particularly advantageous embodiment of the invention, the locking mechanism exhibits the form of an engaging mechanism that becomes effective automatically between the two handles in the activated condition, with said engaging mechanism being designed such that during the clamping of the handles automatic locking occurs in the correct clamping position depending on the exerted clamping force.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
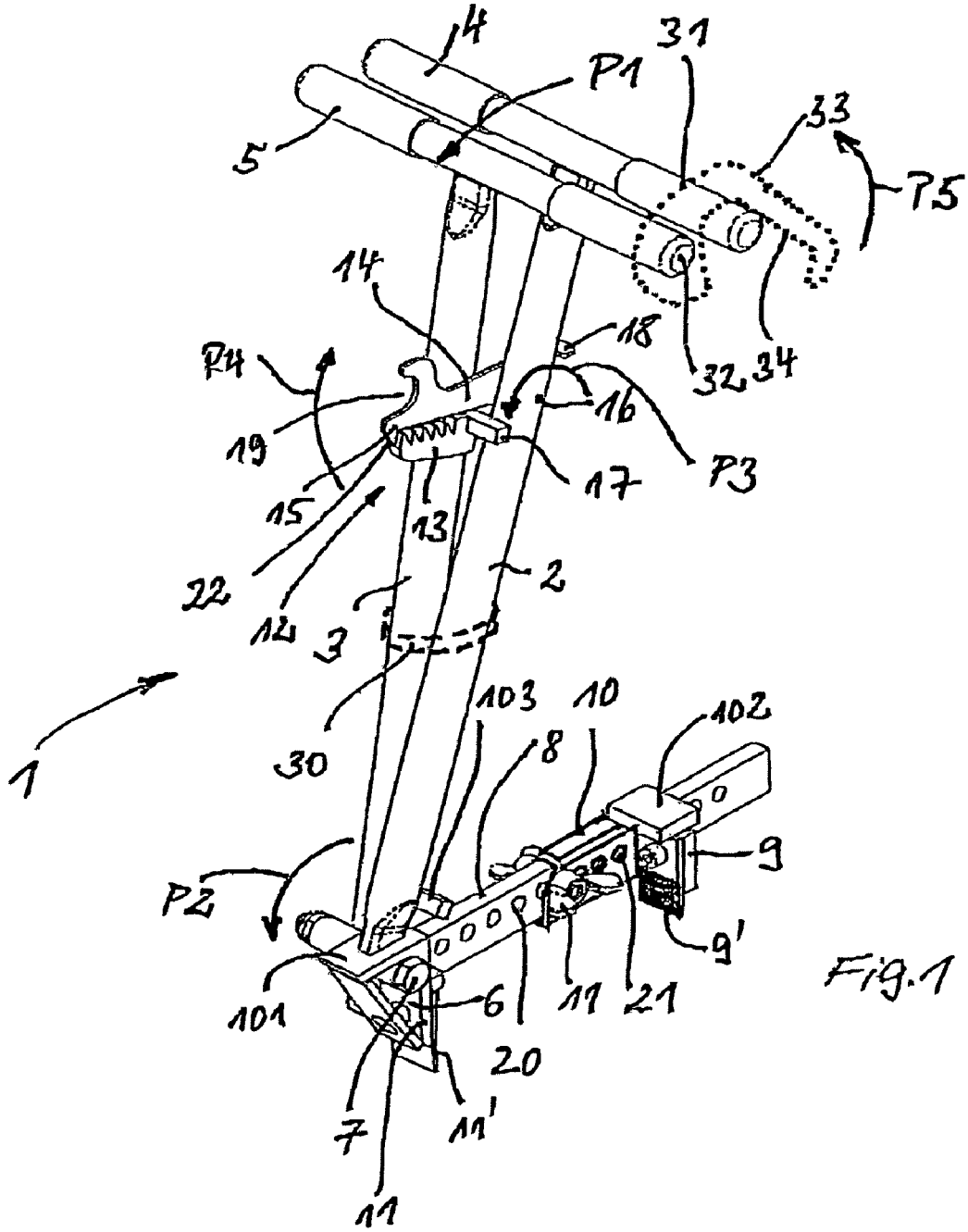
FIG. 1 is a perspective view of the stone lifting device according to the invention.
Figure 2:
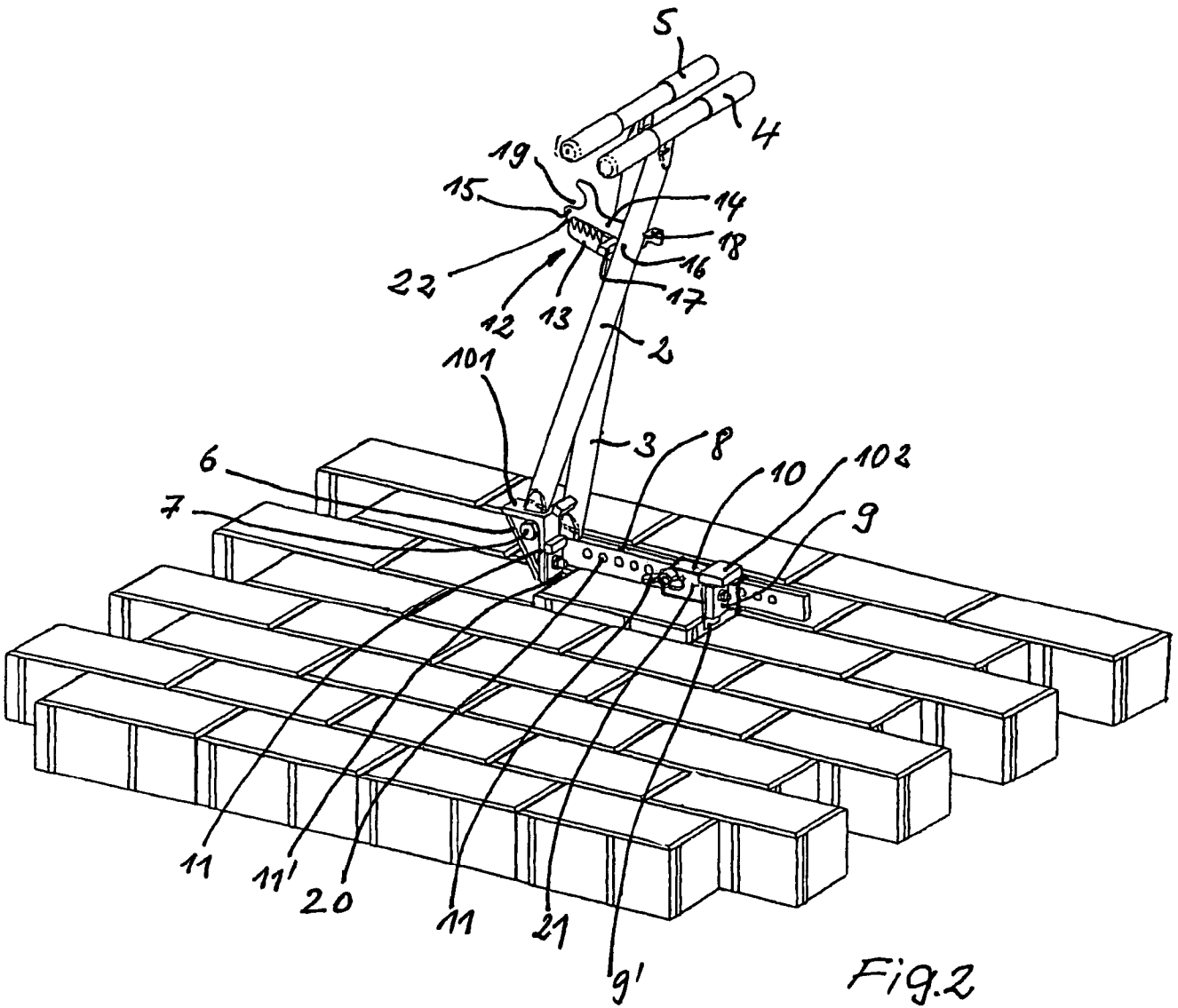
FIG. 2 is the stone lifting device according to the invention during use.

The preferred embodiment of the present invention will now be described with reference to FIGS. 1 and 2 of the drawings. Identical elements in the two figures are designated with the same reference numerals.

The stone lifting device according to the invention comprises two rod-shaped handles 2, 3, which—during use—each exhibit at their upper end region a handle element 4 or 5, respectively, that preferably runs perpendicular to the handle 2, 3.

Advantageously, an attachment component 6 is attached at the lower end region of the handle 2, with the lower end of the handle 3 being pivoted at the axis 7 (arrow 2). Connected to the lower end of the handle 3 is a bar-shaped clamping component 8 that exhibits a gripping jaw 9, which is adjustable in its longitudinal direction. The gripping jaw 9 can be attached to a gliding component 10, for example, which glides along the clamping component 8 and that can be locked in a desired longitudinal position using a screw connection. To this end, several recesses or boreholes 20 are located at a distance from one another in the longitudinal direction of the clamping component 8 that can be selectively aligned with at least one borehole 21 located in the gliding component 10.

An additional gripping jaw 11 is attached to the attachment component 6.

Preferably, the gripping jaws 9, 11 include spring steel components 9', 11', which, when handling the stone lifting device 1 at two opposing sides of a stone to be lifted out of the cobblestone pavement, can be placed such that they are inserted into the respective gaps of the cobblestone pavement from above and in that the handle elements 4, 5 are pulled towards each other in the direction of the arrow P1. In the process, the attachment component 6 with the gripping jaw 11 is pivoted in a pliers-like manner in the direction of the arrow P2 around the axis 7, and the cobblestone is clamped between the gripping jaws 9 and 11. Because the gaps between the stones are filled in with sand when the cobblestones are sanded and solidly anchored in the cobblestone pavement, the spring steel components 9' and 11' cannot be inserted into the gaps easily. For this reason, pressure pick-up surfaces 101, 102 (so-called hammer surfaces) are provided at the gripping jaws 9, 11 and are struck with a hammer for driving in the spring steel components 9', 11'.

According to the present invention, a locking mechanism 12 is provided that is used to lock the handles 2, 3 in relation to each other when a cobblestone is clamped between the gripping jaws (clamping position). Preferably, the locking mechanism has the form of a catch device that exhibits, for example, a gear rack component 13 attached to the handle 3 and catch component 14 that pivots around a rotating axis 16 at the handle 2 (arrow P3), whereby the catch component 14 includes a latch 15 that can engage in the individual tooth spaces of the gear rack component 13. A section of the catch component 14 protrudes past the rotating axis 16 to the side of the gear rack component 13 past the handle 2, such that the latch 15 rests against the gear rack component 13 due to gravity and the rotation of the catch component 14 around the rotating axis 16. When the handles 2, 3 are moved toward each other to clamp a cobblestone, the latch glides over the individual teeth of the gear rack component 13 until the clamping position is reached and the latch reaches behind a respective tooth of the gear rack component 13. Because the entire stone lifting device 1 is, and in particular the handles 2 and 3 are, elastic, the handles 2, 3 spring apart in the clamping position such that the latch 15 is locked or held in the respective catch position. To enable said gliding of the latch 15, it exhibits a respective beveled surface 22 such that it is lifted up at every tooth when gliding over the teeth of the gear rack component 13. Preferably, the individual teeth of the gear rack component 13 run at an angle away from the handle 3, such that a particularly good engagement of the latch 15 is ensured in the clamping position.

At its side, facing the handle 2, the gear rack component 13 can exhibit a stop component 17, which prevents the two handles 2 and 3 from moving too far toward each other. If the stop component 17 were not present, an operator could clamp the fingers between the handle elements 4 and 5. Furthermore, a stop element 103 can be provided at the lower end region of the handle 3, which prevents the two handles 2, 3 from moving too far apart when the locking mechanism is not activated.

Preferably, the catch component 14 exhibits a grip recess 19 in the area of the latch 15. An operator can reach with his fingers into this grip recess 19 to lift up the latch 15 when the locking position of a cobblestone clamped between the gripping jaws 9, 11 is to be released (arrow P4). At the side opposite to the latch 15, in relation to the rotating axis 16, the catch component 14 can exhibit a contact component 18 that prevents the catch component 14 from being pivoted too far around the rotating axis 16. When the contact component 18 rests against the handle 2 underneath the rotating axis 16, the catch component 14 is essentially in a stable parking position that corresponds to the deactivated condition of the locking mechanism 12. Preferably, it is provided that in situations when the contact component 18 contacts the handle 2 above the rotating point 16, the catch component 14 will be in a position of the activated condition, from which it can be lifted or pivoted against the gravity of the catch component 14, in order to glide over the teeth of the gear rack component 13.

It shall be pointed out that other options exist for locking the handles 2, 3 in the clamping position in place of the explained locking mechanism. For example, a locking ring 30 (FIG. 1), which is shown schematically through a broken line and surrounds the handles 2, 3 can be provided, and can be pushed from bottom to top when reaching the clamping position in order to maintain the positions of the handles 2, 3. Furthermore, it is conceivable to place a rotating locking bracket 31 at a handle element 5 around an axis 32 according to the dotted line of FIG. 1, where said locking bracket is pivoted such that a hook-shaped locking component 33 extends beyond the other handle element 4. In this case, the locking component 33 exhibits a contact area 34 for the handle element 4 that runs at an angle from the handle element 4 downward, allowing different opening widths of the handles 2, 3 or different clamping positions, respectively. When pivoting the locking bracket 31 counterclockwise, the locking function is canceled or released (arrow P5).

There has thus been shown and described a novel stone lifting device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A stone lifting device with two handles that pivot in relation to each other, wherein a first gripping jaw is located at an end region of one handle and a second gripping jaw is mechanically connected to an end region of the other handle, wherein the one handle and the other handle can be pivoted in relation to each other at their end regions about an axis such that in the clamping position a stone can be clamped between the first gripping jaw and the second gripping jaw, the improvement comprising a locking mechanism that can be activated and deactivated, wherein in the activated condition in the clamping position the positions of the handles are maintained and the stone remains clamped between the gripping jaws, and wherein in the deactivated condition the clamping position is maintained by a clamping force that is exerted on to the handles manually by an operator, wherein the second gripping jaw is positioned on a gliding component that is adjustable along a bar-shaped clamping component in a longitudinal direction thereof, whereby the clamping component is attached to the end region of the other handle.

2. A stone lifting device as set forth in claim 1, wherein each of the one handle and of the other handle has a handle element which is located perpendicular to a longitudinal axis of the one or the other handle.

3. A stone lifting device as set forth in claim 2, wherein the locking mechanism comprises a locking bracket, one side of which is pivoted at a handle element around an axis, while the other side includes a hook-shaped locking component that reaches over the other handle element in a fastening manner in the activated condition.

4. A stone lifting device as set forth in claim 3, wherein the hook-shaped locking bracket includes a contact area for the other handle element that runs at an angle from the one handle element downward to the clamping component in order to adjust to different clamping positions.

5. A stone lifting device as set forth in claim 1, wherein the first gripping jaw and the second gripping jaw each include a spring steel component, the spring steel components being adapted to act upon opposite sides of the stone.

6. A stone lifting device as set forth in claim 1, wherein a plurality of openings are located in the clamping component, at a distance from one another along the longitudinal direction of the clamping component, wherein an opening in the gliding component is alignable with said openings in the clamping component, and wherein a fastening device is insertable in the aligned openings.

7. A stone lifting device as set forth in claim 1, wherein the locking mechanism includes a catch component located on the one handle at a distance from the axis and a gear rack component located on the other handle and wherein the catch component includes a latch, which in the activated condition of the locking mechanism in the clamping position engages in a tooth of the gear rack component.

8. A stone lifting device as set forth in claim 7, wherein the catch component pivots around a rotating axis about the one handle and wherein the latch is at such a distance from the rotating axis that it engages the tooth due to a force of gravity on the catch component.

9. A stone lifting device as set forth in claim 8, wherein the catch component includes at the opposite side of the rotating axis, in relation to the latch, a contact component such that the catch component assumes one stable position in the deactivated condition of the locking mechanism when the contact component contacts the one handle underneath the rotating axis and assumes another position in the activated condition when the contact component contacts the one handle above the rotating axis from which it can pivot against a force of gravity in order to glide over the teeth of the gear rack component.

10. A stone lifting device as set forth in claim 8, wherein the catch component includes a grip recess in the area of the latch where a finger of the operator can be inserted in order to pivot the catch component from the activated into the deactivated condition of the locking mechanism.

11. A stone lifting device as set forth in claim 1, wherein the locking mechanism includes a locking ring catch component that surrounds the one handle and the other handle and that can be moved along the handles such that it maintains the position of the handles when in the activated condition of the locking mechanism.

12. A stone lifting device as set forth in claim 1, wherein the gripping jaws each exhibit a pressure pick-up surface onto which a force can be exerted with a tool for driving spring steel components into sand-filled gaps in a pavement.

* * * * *